US010410589B2

(12) United States Patent
Zhang

(10) Patent No.: US 10,410,589 B2
(45) Date of Patent: Sep. 10, 2019

(54) METHOD FOR CONTROLLING BACKLIGHT SOURCE BASED ON SYNCHRONOUS SIGNAL COMPENSATION AND LIQUID CRYSTAL DISPLAY

(71) Applicants: HISENSE ELECTRIC CO., LTD., Qingdao (CN); HISENSE USA CORPORATION, Suwanee, GA (US); HISENSE INTERNATIONAL CO., LTD., Qingdao (CN)

(72) Inventor: Yuxin Zhang, Qingdao (CN)

(73) Assignees: HISENSE ELECTRIC CO., LTD., Shandong (CN); HISENSE USA CORPORATIONGA (US); HISENSE INTERNATIONAL CO., LTD., Shandong (CN)

( * ) Notice: Subject to any disclaimer, the term of this patent is extended or adjusted under 35 U.S.C. 154(b) by 81 days.

(21) Appl. No.: 15/375,043

(22) Filed: Dec. 9, 2016

(65) Prior Publication Data

US 2017/0337881 A1 Nov. 23, 2017

(30) Foreign Application Priority Data

May 18, 2016 (CN) ..... 2016 1 0333460

(51) Int. Cl.
*G09G 3/36* (2006.01)
*G09G 3/34* (2006.01)

(52) U.S. Cl.
CPC ..... *G09G 3/3406* (2013.01); *G09G 3/36* (2013.01); *G09G 2310/08* (2013.01); *G09G 2320/064* (2013.01)

(58) Field of Classification Search
CPC ..... G09G 3/2096; G09G 3/3406; G09G 3/32; G09G 3/36; G09G 3/3426; G09G 3/3611; G09G 2310/08; G09G 2320/064
See application file for complete search history.

(56) References Cited

U.S. PATENT DOCUMENTS

2010/0060555 A1* 3/2010 Lee ..... G09G 3/3426 345/82
2010/0110097 A1* 5/2010 Nam ..... G09G 3/3426 345/589

(Continued)

FOREIGN PATENT DOCUMENTS

CN 101673518 B * 4/2013 ..... G09G 3/3426

*Primary Examiner* — Jennifer Mehmood
*Assistant Examiner* — James S Nokham
(74) *Attorney, Agent, or Firm* — J.C. Patents

(57) ABSTRACT

The present application provides a method for controlling a backlight source, a device for controlling a backlight source and a liquid crystal display, where the method includes: determining time intervals of received synchronous signals; determining an output delay compensation value of the synchronous signals, according to the time intervals and fixed response delay time for processing the synchronous signals; generating a compensated synchronous signal according to the output delay compensation value of the synchronous signals; transmitting the compensated synchronous signal to a PWM driver. The application allows a backlight source to perform optical display according to multipath control signals with relatively stable frequency, and reduces backlight blinking of the backlight source.

16 Claims, 9 Drawing Sheets

(56) References Cited

U.S. PATENT DOCUMENTS

| | | | | |
|---|---|---|---|---|
| 2011/0084987 | A1* | 4/2011 | Kim | G09G 3/342<br>345/690 |
| 2011/0175935 | A1* | 7/2011 | S | G09G 3/3406<br>345/690 |
| 2011/0267375 | A1* | 11/2011 | Yang | G09G 3/3406<br>345/690 |
| 2014/0132493 | A1* | 5/2014 | Wu | G09G 3/3611<br>345/87 |
| 2015/0371594 | A1* | 12/2015 | Huang | G09G 3/003<br>345/690 |
| 2016/0078821 | A1* | 3/2016 | Lee | G09G 3/3426<br>345/102 |
| 2017/0027032 | A1* | 1/2017 | Kong | G09G 3/32 |

* cited by examiner

METHOD FOR CONTROLLING BACKLIGHT SOURCE BASED ON SYNCHRONOUS SIGNAL COMPENSATION AND LIQUID CRYSTAL DISPLAY

CROSS REFERENCE TO RELATED APPLICATIONS

The present application claims priority to Chinese patent application No. 201610333460.5, entitled "METHOD FOR CONTROLLING BACKLIGHT SOURCE, DEVICE FOR CONTROLLING BACKLIGHT SOURCE AND LIQUID CRYSTAL DISPLAY" and filed to SIPO on May 18, 2016, which is hereby incorporated by reference in its entirety.

TECHNICAL FIELD

The present application relates to backlight control technologies, and particularly to a method for controlling a backlight source, a device for controlling a backlight source and a liquid crystal display.

BACKGROUND

Liquid crystal displays have become an important display means, along with development of liquid crystal display technologies. And dynamic backlight technologies have been widely applied in liquid crystal displays. The liquid crystal display requires adopting dynamic backlight control technologies to drive a backlight source, thus allowing the backlight source to display images.

In the related art, a liquid crystal display has an image processing chip, a timing controller, a backlight driving module and a backlight source, where the backlight driving module has a backlight processing unit and a pulse width modulation (PWM) driver. After receiving video signals, the image processing chip conducts image processing to the video signals and outputs image data to the timing controller, and outputs synchronous signals and partition backlight data to the backlight driving module; the backlight processing unit of the backlight driving module generates duty cycle data and backlight current values according to the received synchronous signals and partition backlight data, and transmits the synchronous signals, the duty cycle data and the backlight current values to the PWM driver; thus the PWM driver is able to generate multiple paths of control signals according to the synchronous signals, the duty cycle data and the backlight current values; the PWM driver transmits the multiple paths of control signals to the backlight source, allowing the backlight source to perform optical display according to the multiple paths of control signals.

However, in the related art, the image processing chip performs other tasks, for example, searching satellite TV signals, while conducting image processing to video signals; the image processing chip functions in line with a multi-task processing mechanism. Therefore, frequency jitters with a certain magnitude will occur to synchronous signals transmitted by the image processing chip to the backlight driving module. FIG. 1 is a schematic diagram illustrating synchronous signals received and outputted by a backlight driving module in the related art, as shown in FIG. 1, number (1) in FIG. 1 is a schematic diagram illustrating synchronous signals transmitted by an image processing chip to a backlight driving module in the related art; number (2) in FIG. 1 is a schematic diagram illustrating synchronous signals transmitted by a backlight processing unit of a backlight driving module to a PWM driver in the related art. As shown in FIG. 1, the backlight processing unit of the backlight driving module also transmits the synchronous signals to the PWM driver, which accordingly generates control signals with frequency jitters; after the backlight source receives the control signals with frequency jitters, a backlight blinking phenomenon emerges when the backlight source performs optical display according to the control signals.

SUMMARY

The present application provides a method for controlling a backlight source, a device for controlling a backlight source and a liquid crystal display.

Several embodiments of the present application provide a method for controlling a backlight source, which includes:

determining time intervals of received synchronous signals;

determining an output delay compensation value of the synchronous signals, according to the time intervals and fixed response delay time for processing the synchronous signals;

generating a compensated synchronous signal according to the output delay compensation value of the synchronous signals; and transmitting the compensated synchronous signal to a PWM driver.

Another several embodiments of the present application provide a device for controlling a backlight source, which includes a processor and a non-transitory processor-readable medium including computer-executable instructions executed by the computing hardware to perform, on the device, operations including:

determining time intervals of received synchronous signals;

determining an output delay compensation value of the synchronous signals, according to the time intervals and fixed response delay time for processing the synchronous signals; and generating a compensated synchronous signal according to the output delay compensation value of the synchronous signals; and transmitting the compensated synchronous signal to a PWM driver.

Another several embodiments of the present application provide a liquid crystal display, which includes:

an image processing chip, a backlight source, a PWM driver, and a device for controlling the backlight source as described above;

the device for controlling the backlight source is connected between the image processing chip and the PWM driver, and the PWM driver is connected between the device for controlling the backlight source and the backlight source.

DESCRIPTION OF EMBODIMENTS

In order to make the purpose, technical solutions and advantages of embodiments of the present application clearer, the technical solutions of embodiments of the present application will be described clearly and completely in conjunction with drawings accompanying the embodiments of the present application, the described embodiments are merely part rather than all embodiments of the present application. And all the other embodiments acquired by one with ordinary skill in the art based on the embodiments of the present application without creative efforts shall fall into the protection scope of the present application.

Figure 1:
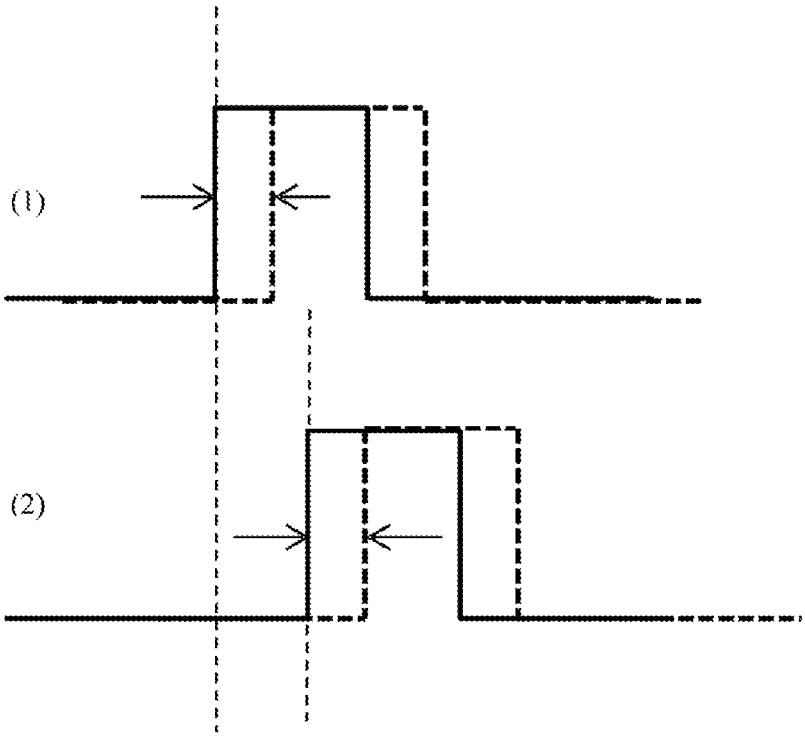
FIG. 1 (Related Art)
FIG. 1 is a schematic diagram illustrating synchronous signals received and outputted by a backlight driving module in the related art.
Figure 2:
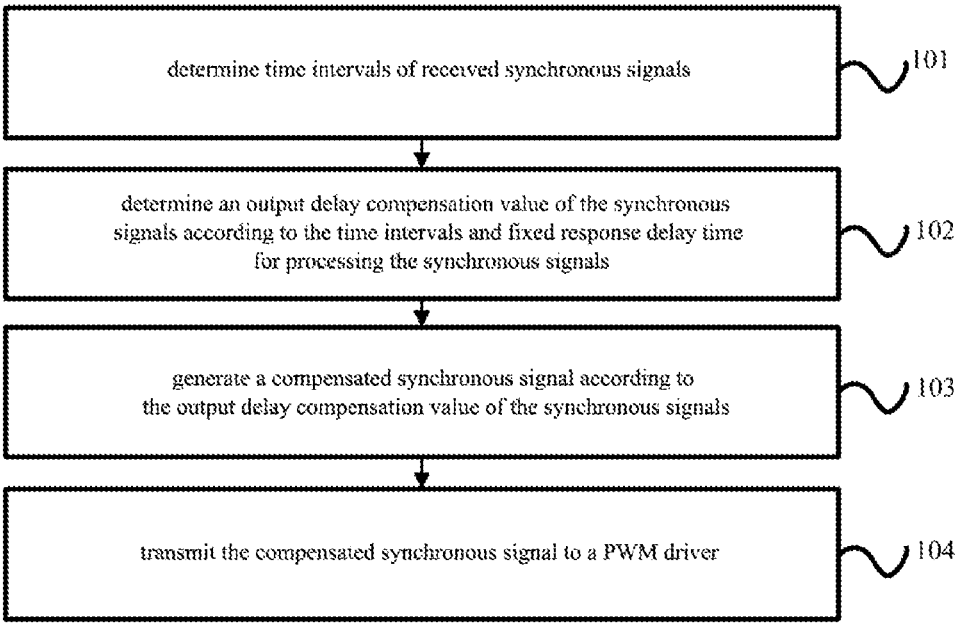
FIG. 2 is a flowchart of a method for controlling a backlight source provided by several embodiments of the present application.

FIG. 2 is a flowchart of a method for controlling a backlight source provided by several embodiments of the present application, as shown in FIG. 2, the method includes:

Step 101, determine time intervals of received synchronous signals.

A liquid crystal display is provided with an image processing chip, a timing controller, a backlight driving module and a backlight source, where the backlight driving module is provided with a backlight processing unit, a PWM driver and a direct current/direct current (DC/DC) convertor; and the image processing chip is composed of an image gray scale compensation unit, a partition backlight value extraction unit and a backlight optical diffusion model storage unit and other units; after the image processing chip receives video signals, the image gray scale compensation unit, the partition backlight value extraction unit and the backlight optical diffusion model storage unit and other units of the image processing chip conduct image processing to the video signals, then the image gray scale compensation unit of the image processing chip transmits image data to the timing controller, and the partition backlight value extraction unit of the image processing chip outputs synchronous signals and partition backlight data to the backlight driving module. The DC/DC convertor in the backlight driving module is configured to perform protection detection to the backlight processing unit, and carry out operations such as receiving feedback signals outputted by the PWM driver.

Figure 3:
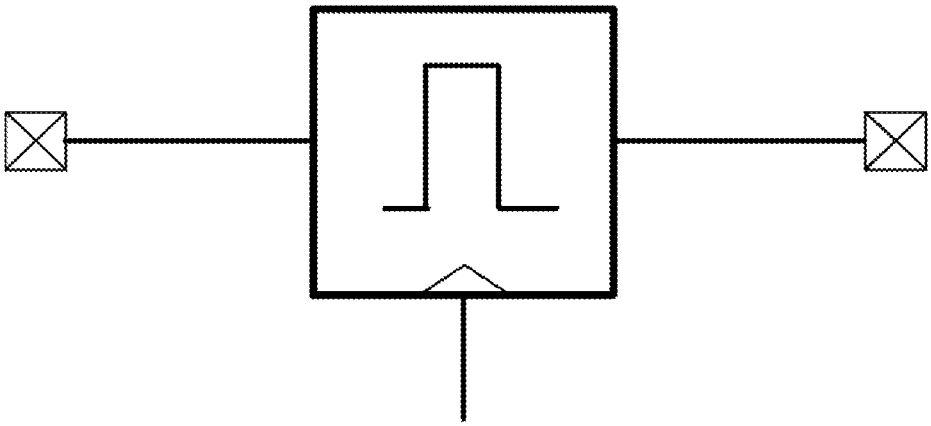
FIG. 3 is a schematic diagram illustrating a circuit for detecting synchronous signals from an image processing chip in a method for controlling a backlight source provided by several embodiments of the present application.

The backlight processing unit in the backlight driving module receives the synchronous signals and the partition backlight data outputted by the image processing chip. FIG. 3 is a diagram illustrating a circuit for detecting synchronous signals from an image processing chip in a method for controlling a backlight source provided by several embodiments of the present application. As shown in FIG. 3, firstly, the backlight processing unit adopts a synchronous signal edge detection circuit or a software detection mechanism to detect the synchronous signals outputted by the partition backlight value extraction unit of the image processing chip, and the backlight processing unit synchronously receives the partition backlight data outputted by the partition backlight value extraction unit.

After that, respective time intervals of the received synchronous signals may be detected.

For example, 101 synchronous signals are detected, then 100 time intervals may be calculated, with time intervals of all the synchronous signals being the same.

Step 102, determine an output delay compensation value of the synchronous signals according to the time intervals and fixed response delay time for processing the synchronous signals.

Figure 4:
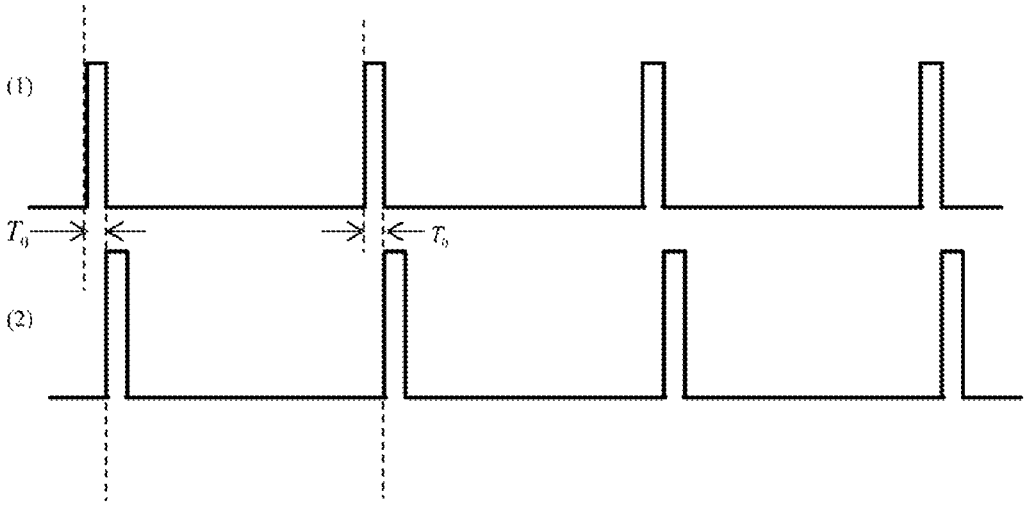
FIG. 4 is a timing diagram of synchronous signals received and outputted by a backlight processing unit in the related art.
Figure 5:
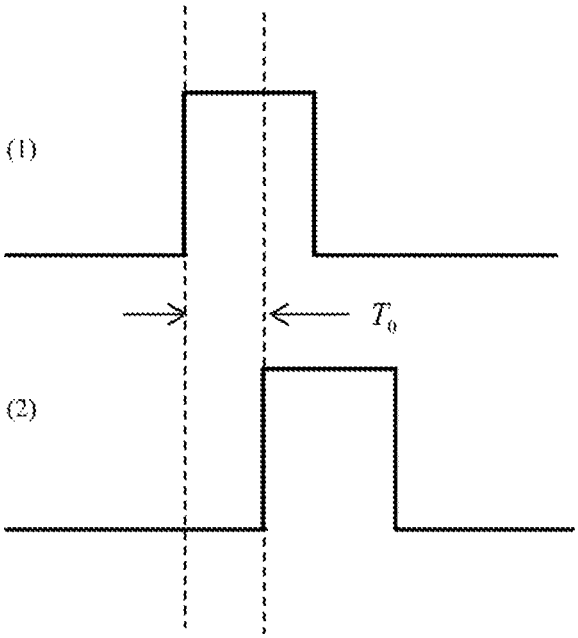
FIG. 5 is another timing diagram of synchronous signals received and outputted by a backlight processing unit in the related art.

There is fixed response delay time between the backlight processing unit detecting the synchronous signals and the synchronous signals being transmitted to the PWM driver. FIG. 4 is a timing diagram of synchronous signals received and outputted by a backlight processing unit in the related art, FIG. 5 is another timing diagram of synchronous signals received and outputted by a backlight processing unit in the related art, number (1) in FIG. 4 is a timing diagram of synchronous signals received by the backlight processing unit from the image processing chip, number (2) in FIG. 4 is a timing diagram of synchronous signals transmitted by the backlight processing unit to the PWM driver; number (1) in FIG. 5 is a schematic diagram of synchronous signals received by the backlight processing unit from the image processing chip, number (2) in FIG. 5 is a schematic diagram of synchronous signals transmitted by the backlight processing unit to the PWM driver. As shown in FIG. 4 and FIG. 5, the synchronous signals transmitted by the backlight processing unit to the PWM driver have fixed response delay time $T_0$, i.e., fixed response delay time for processing the synchronous signals.

The output delay compensation value of the synchronous signals may be calculated according to the respective time intervals of the synchronous signals and the fixed response delay time for processing the synchronous signals. If N+1 synchronous signals are received, then the output delay compensation value for a subsequent synchronous signal of the N+1 synchronous signals may be calculated according to the determined N time intervals of the N+1 synchronous signals and the fixed response delay time for processing the synchronous signals $T_0$; or perform, according to the determined N time intervals of the N+1 synchronous signals and the fixed response delay time for processing the synchronous signals $T_0$, look-up in a pre-created two-dimensional table, in which a relationship of the time intervals and the fixed response delay time corresponding one-to-one to the output delay compensation value is stored, and determine, via the look-up, the output delay compensation value for the subsequent synchronous signal of the N+1 synchronous signals corresponding to the current time interval and fixed response delay time.

For example, 100 time intervals may be computed if 101 synchronous signals are detected; according to these 100 time intervals and the fixed response delay time for processing the synchronous signals, perform look-up in the two-dimensional table, and determine the output delay compensation value corresponding to the time intervals and the fixed response delay time.

Step 103, generate a compensated synchronous signal according to the output delay compensation value of the synchronous signals.

After computing the output delay compensation value of the synchronous signals, a compensated synchronous signal can be generated according to the output delay compensation value of the synchronous signals. In some embodiments, the output delay compensation value may be applied to a synchronous signal to generate a compensated synchronous signal.

For example, regarding the received N+1 synchronous signals, apply the output delay compensation value computed for the next synchronous signal of the N+1 synchronous signal to the next synchronous signal, so that an output delay compensation value is applied to the next synchronous signal of the N+1 synchronous signal, so as to compensate the next synchronous signal of the N+1 synchronous signals; and compensated synchronous signals may be generated by repeating the processes in step 101-step 103 for the synchronous signals.

In some embodiments, after computing an output delay compensation value of the received synchronous signals, the same output delay compensation value may be applied to a plurality of synchronous signal following the received synchronous signals, so as to generate a plurality of compensated synchronous signals. For example, regarding the received N+1 synchronous signals, apply the computed output delay compensation value of the N+1 synchronous signal to M synchronous signals following the N+1 synchronous signals, so as to compensate these M synchronous signals, and thus M compensated synchronous signals may be generated.

It should be noted that the manner of generating a compensated synchronous signal according to the output delay compensation value of the synchronous signals is not limited to the above manners.

Step 104, transmit the compensated synchronous signals to the PWM driver.

According to the compensated synchronous signals and the partition backlight data, generate duty cycle data and backlight current data, and transmit the duty cycle data, the backlight current data and the compensated synchronous signals to the PWM driver, so that the PWM driver generates P paths of control signals according to the duty cycle data, the backlight current data and the compensated synchronous signals, and then transmits the P paths of control signals to the backlight source, where P is a positive integer.

For example, the compensated synchronous signals may be transmitted to the PWM driver, and the generated duty cycle data and the backlight current data are also transmitted to the PWM driver, such that the PWM driver may generate 20 paths of parallel control signals according to the above data, and transmit the 20 paths of parallel control signals to the backlight source.

Figure 6:
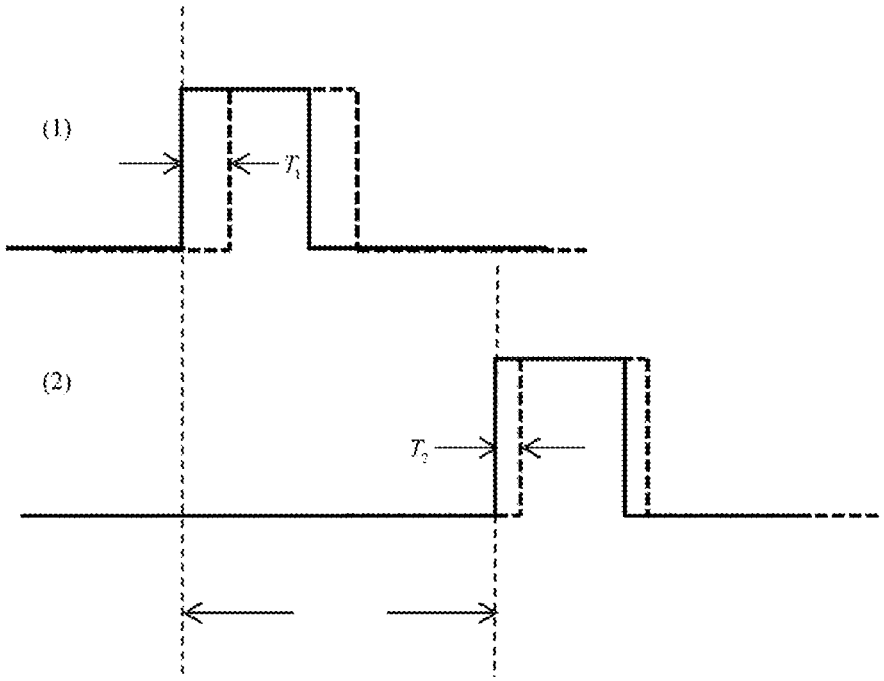
FIG. 6 is a schematic diagram illustrating synchronous signals received from an image processing chip and synchronous signals outputted to a PWM driver in a method for controlling a backlight source provided by several embodiments of the present application.

The backlight processing unit of the backlight driving module generates the duty cycle data and the backlight current data according to the compensated synchronous signals and according to the partition backlight data received from the partition backlight value extraction unit of the image processing chip. The backlight processing unit transmits the generated duty cycle data and backlight current data to the PWM driver; meanwhile, the backlight processing unit also transmits the compensated synchronous signals to the PWM driver. FIG. 6 is a diagram of synchronous signals received from an image processing chip and synchronous signals outputted to a PWM driver in a method for controlling a backlight source provided by several embodiments of the present application, where number (1) in FIG. 6 is a schematic diagram of synchronous signals received from an image processing chip in a method for controlling a backlight source provided by several embodiments of the present application, and number (2) in FIG. 6 is a schematic diagram of synchronous signals outputted to a PWM driver in a method for controlling a backlight source provided by several embodiments of the present application As shown in FIG. 6, the method provided by the present application can reduce frequency jitters of synchronous signals, and reduce the magnitude of the frequency jitters of the synchronous signals transmitted to the PWM driver from $T_1$ to $T_2$.

The PWM driver generates P paths of control signals according to the received duty cycle data, backlight current data and compensated synchronous signals, where time delay also exists among the respective paths of control signals. Since a backlight source is usually lit up according to sequential scanning of pixels of a liquid crystal display, lighting up of the backlight source needs to be enabled at certain time intervals under control by signals, thus a certain time interval is needed between adjacent control signals in multiple paths of control signals transmitted by the PWM driver to the backlight source, so as to achieve scanning in synchronization with that of the liquid crystal display, thereby reducing image tailing, and improving the fluency of moving images.

Figure 7:
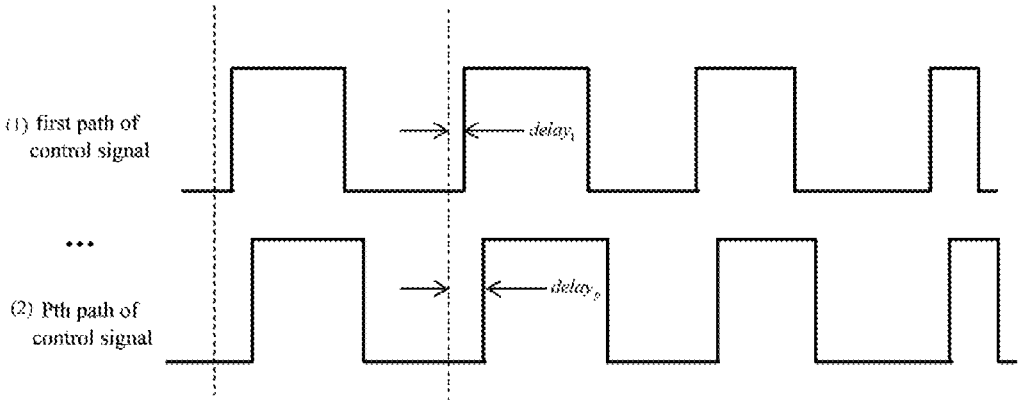
FIG. 7 is a timing diagram of P paths of control signals outputted from a PWM driver in a method for controlling a backlight source provided by several embodiments of the present application.

FIG. 7 is a timing diagram of P paths of control signals outputted from a PWM driver in a method for controlling a backlight source provided by several embodiments of the present application, number (1) in FIG. 7 is a timing diagram of a first path of control signal outputted from a PWM driver in a method for controlling a backlight source provided by several embodiments of the present application, number (2) in FIG. 7 is a timing diagram of a Pth path of control signal outputted from a PWM driver in a method for controlling a backlight source provided by several embodiments of the present application As shown in FIG. 7, values of the time delays of the P paths of control signals form an arithmetic progression, and the values of the time delays increase in sequence; the value of the time delay for the first path of control signal is $delay_1$, the value of the time delay for the second path of control signal is $delay_2$, and by this analogy, the value of the time delay of the Pth path of control signal is $delay_p$, where the value of $delay_1$ is set as practically needed, and P is a positive integer.

The PWM driver transmits the generated P paths of control signals to the backlight source, allowing the backlight source to perform optical display and display of images according to the received P paths of control signals.

In the present application, by detecting synchronous signals outputted by the image processing chip, receiving partition backlight data outputted from the image processing chip, and computing the output delay compensation value for the subsequent synchronous signal according to time intervals of the synchronous signals and fixed response delay time for processing the synchronous signals, cycle compensation may be conducted to the subsequent synchronous signal of the synchronous signals, so as to reduce the magnitude of frequency jitters of the synchronous signals; dynamic cycle compensation to the synchronous signals can alleviate the frequency jitter problem of the synchronous signals outputted to the backlight driving module by the image processing chip, so that the PWM driver can receive synchronous signals with frequency jitters having a reduced magnitude, as well as duty cycle data and backlight current data, and thus, frequency jitters of multiple paths of control signals generated by the PWM driver according to these data and signals will also be reduced, allowing the backlight source to receive multiple paths of control signals, generated by the PWM driver, with relatively stable frequency; and finally the backlight source can perform optical display according to the multiple paths of control signals with relatively stable frequency, thus alleviating backlight blinking phenomenon of the backlight source, lessening backlight blinking of the backlight source, thereby improving image quality of the liquid crystal display.

Figure 8:
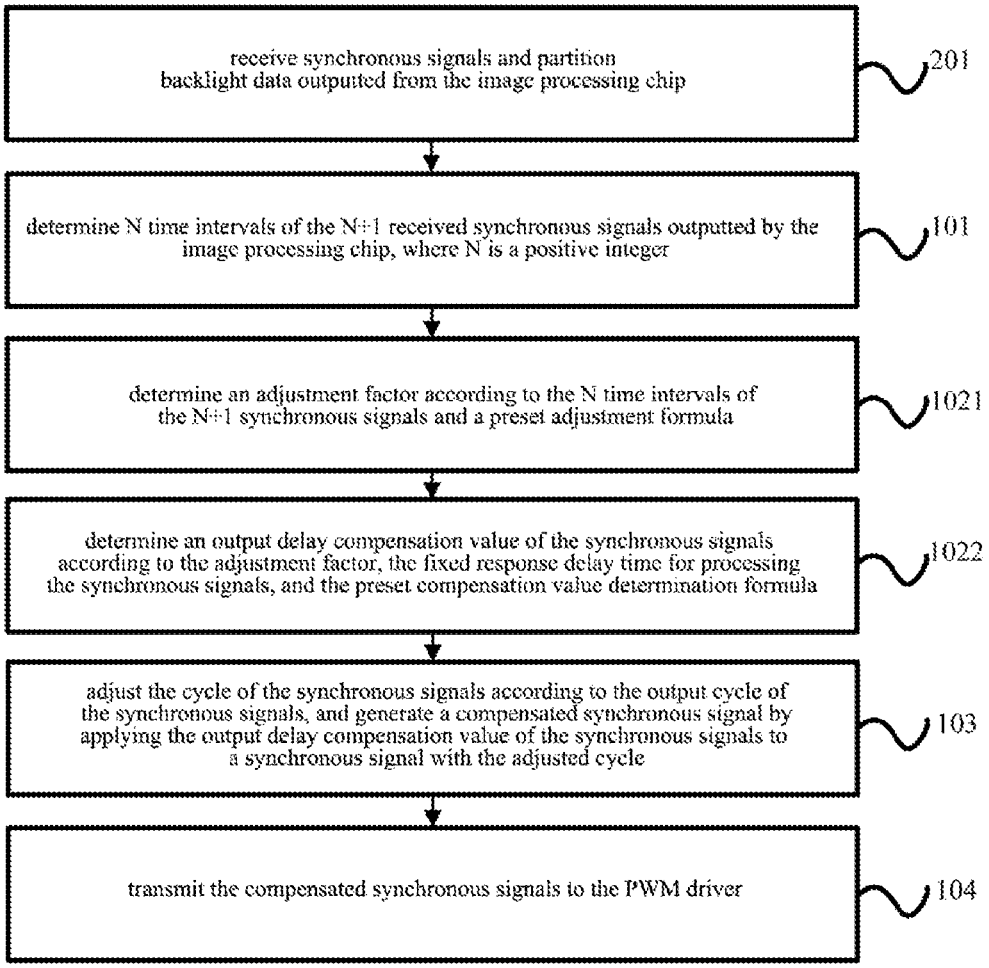
FIG. 8 is a flowchart of a method for controlling a backlight source provided by another several embodiments of the present application.

FIG. 8 is a flowchart of a method for controlling a backlight source provided by another several embodiments of the present application, as shown in FIG. 8, on the basis of the above embodiments, prior to step 101, the method also includes:

Step 201, receive synchronous signals and partition backlight data outputted from the image processing chip.

The partition backlight value extraction unit in the image processing chip outputs synchronous signals and partition backlight data to the backlight driving module, which may receive N+1 synchronous signals and partition backlight data outputted by the image processing chip.

For example, 101 synchronous signals and partition backlight data outputted by the image processing chip may be received.

Step 101 includes: determine N time intervals of the N+1 received synchronous signals outputted by the image processing chip, where N is a positive integer.

N+1 synchronous signals outputted by the image processing chip are received, where N is a positive integer, and since there are N time intervals of the N+1 synchronous signals, the backlight processing unit can compute N time intervals for the detected N+1 synchronous signals.

For example, 101 synchronous signals have 100 time intervals, so that the backlight processing unit can compute 100 time intervals for the detected 101 synchronous signals.

Step 102 includes:

Step 1021, determine an adjustment factor according to the N time intervals of the N+1 synchronous signals and a preset adjustment formula.

Where step 1021 includes: determine the adjustment factor $$T_c = \left(\sum_{N-M}^{N} T_i\right) \Big/ M - T_N$$

according to the N time intervals $T_i$ of the N+1 synchronous signals.

There is a time interval $T_i$ between adjacent synchronous signals in the N+1 synchronous signals, and the time intervals of the respective adjacent synchronous signals may be the same or different. The N+1 synchronous signals have N time intervals $T_i$, the time interval between the first synchronous signal and the second synchronous signal is $T_1'$ the time interval between the second synchronous signal and the third synchronous signal is $T_2$, and by this analogy, the time interval between the Nth synchronous signal and the (N+1) th synchronous signal is $T_N$.

An adjustment factor is introduced, and the value of the adjustment factor is computed according to the determined N time intervals of the N+1 synchronous signals Perform difference compensation according to the time intervals of the last M synchronous signals in the detected N+1 synchronous signals, and obtain the adjustment factor $$T_c = \left(\sum_{N-M}^{N} T_i\right) \Big/ M - T_N$$

according to a preset compensation value determination formula, where $T_N$ is the time interval between the last synchronous signal and the second last synchronous signal in the detected N+1 synchronous signals, and i is a positive integer between 1 and N.

For example, 101 synchronous signals are detected, time intervals of the last 10 synchronous signals in the 101 synchronous signals are determined, where N is 101, and M is 10; and time interval $T_{100}$ between the 100th synchronous signal and the 101th synchronous signal may be obtained, thus obtaining the adjustment factor $$T_c = \left(\sum_{90}^{100} T_i\right) \Big/ 10 - T_{100}.$$

Step 1022, determine an output delay compensation value of the synchronous signals according to the adjustment factor, the fixed response delay time for processing the synchronous signals, and the preset compensation value determination formula.

where Step 1022 includes: determine the output delay compensation value $T_0'=(T_0+T_c)/x$ of the synchronous signals, according to the adjustment factor $T_c$ and the fixed response delay time for processing the synchronous signals $T_0$, where x is a frequency multiplication number for performing frequency multiplication processing of the synchronous signals; where, $i \in [1, N]$, M, i and x are positive integers.

The output delay compensation value $T_0'=(T_0+T_c)/x$ for the subsequent synchronous signal of the N+1 synchronous signals may be computed according to the adjustment factor $T_c$ and intrinsic fixed response delay time $T_0$ during processing of the synchronous signals by the backlight processing unit. In addition, x, a positive integer, is the frequency multiplication number for performing frequency multiplication processing on the synchronous signals by the backlight processing unit of the backlight driving module.

In the case where the synchronous signals are not subject to the frequency multiplication processing by the backlight processing unit in the backlight driving module, then x equals to 1, thus the output delay compensation value computed for the subsequent synchronous signal of the N+1 synchronous signals is $T_0'=(T_0+T_c)$.

In the case where the synchronous signals are subject to frequency multiplication processing by the backlight processing unit in the backlight driving module, then x is a positive integer greater than or equal to 2, thus the output delay compensation value computed for the subsequent synchronous signal of the N+1 synchronous signals is $T_0'=(T_0+T_c)/x$.

If the time interval $T_N$ between the detected last synchronous signal and the second last synchronous signal is less than the average time interval of the M synchronous signals, namely, $T_N$ is less than $$\left(\sum_{N-M}^{N} T_i\right)\Big/ M,$$

the obtained adjustment factor $T_c$ is positive; the obtained output delay compensation value $T_0'$ increases on the basis of the fixed response delay time $T_0$, therefore after generating the compensated synchronous signal according to the output delay compensation value $T_0'$, the obtained synchronous signal will still keep a relatively stable cycle. And if the time interval $T_N$ between the detected last synchronous signal and the second last synchronous signal is greater than the average time interval of the M synchronous signals, namely, $T_N$ is greater than $$\left(\sum_{N-M}^{N} T_i\right)\Big/ M,$$

then the obtained adjustment factor $T_c$ is negative; the obtained output delay compensation value $T_0'$ will decrease on the basis of the fixed response delay time $T_0$, and the resulted synchronous signal will still keep a relatively stable cycle. Thus, such variable delay control method can effectively reduce the magnitude of frequency jitters of synchronous signals outputted to the PWM driver.

In the present application, by determining an adjustment factor according to time intervals of the synchronous signals, and computing the output delay compensation value for the subsequent synchronous signal of the N+1 synchronous signals according to the adjustment factor and intrinsic fixed response delay time during processing of the synchronous signals by the backlight processing unit, the computed output delay compensation value may be applied to the subsequent synchronous signal of the synchronous signals, and then cycle compensation is performed to the subsequent synchronous signal of the synchronous signals, so as to reduce the magnitude of frequency jitters of the synchronous signals; dynamic cycle compensation to the synchronous signals may alleviate the frequency jitter problem of the synchronous signals outputted to the backlight driving module by the image processing chip, so that the PWM driver can receive synchronous signals with frequency jitters having a reduced magnitude, as well as duty cycle data and backlight current data, and thus, frequency jitters of multiple paths of control signals generated by the PWM driver according to these data and signals will also be reduced, allowing the backlight source to receive multiple paths of control signals, generated by the PWM driver, with relatively stable frequency, and finally the backlight source can perform optical display according to the multiple paths of control signals with relatively stable frequency, thereby alleviating backlight blinking phenomenon of the backlight source, lessening backlight blinking of the backlight source, thereby improving the image quality of the liquid crystal display.

Figure 9:
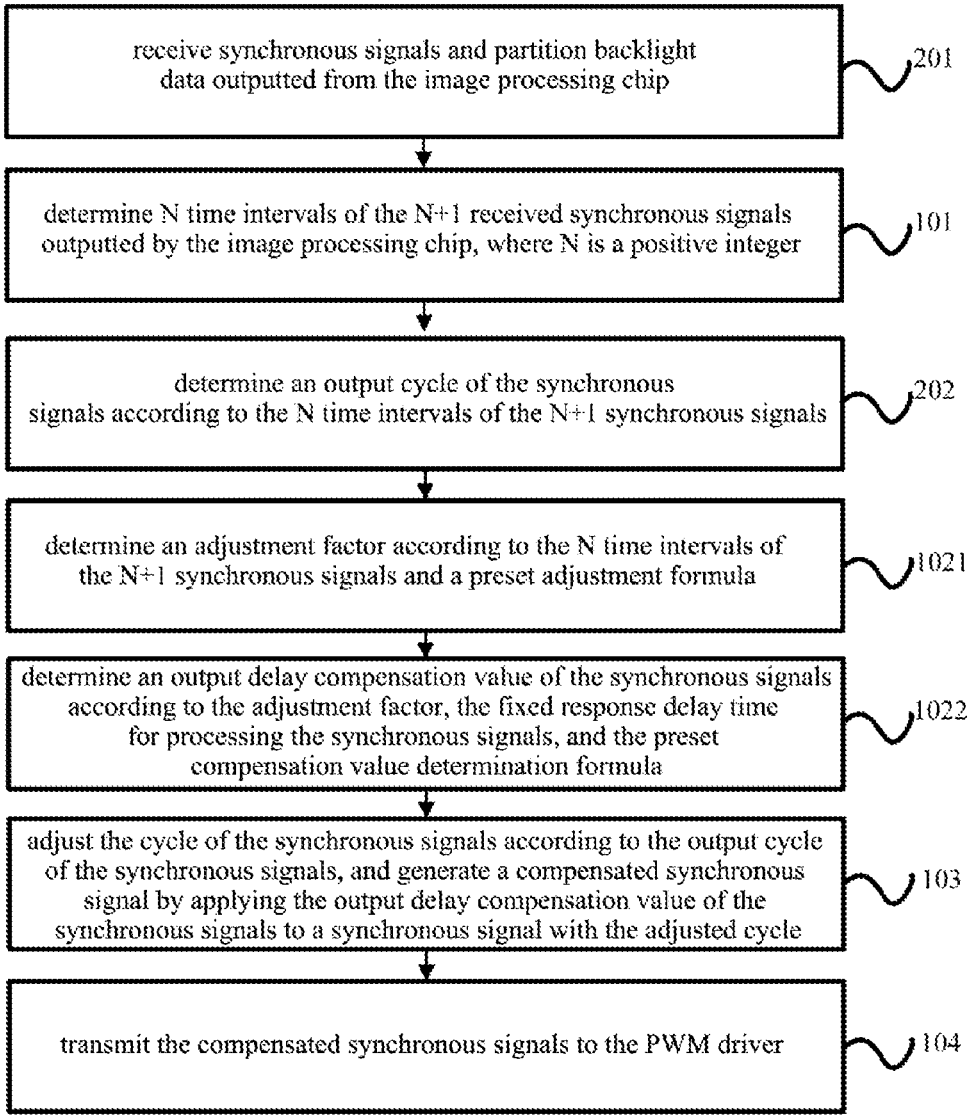
FIG. 9 is a flowchart of a method for controlling a backlight source provided by yet another several embodiments of the present application.

FIG. 9 is a flowchart of a method for controlling a backlight source provided by yet another several embodiments of the present application, as shown in FIG. 9, based on the above embodiments, x is a positive integer greater than or equal to 2.

Prior to step 102, the method also includes:

Step 202, determine an output cycle of the synchronous signals according to the N time intervals of the N+1 synchronous signals.

Step 202 may include:

determine the output cycle $T'=T_N/x$ of the synchronous signals, according to the last time interval $T_N$ in the N time intervals of the N+1 synchronous signals and the frequency multiplication number x for performing the frequency multiplication processing on the synchronous signals;

or, determine the output cycle $$T' = \left(\sum_{N-M}^{N} T_i\right)\Big/ (M \times x)$$

of the synchronous signals, according to the last M time intervals in the N time intervals of the N+1 synchronous signals and the frequency multiplication number x for performing the frequency multiplication processing on the synchronous signals.

If the synchronous signals are subject to frequency multiplication processing by the backlight processing unit of the backlight driving module, then x is a positive integer greater than or equal to 2. In case where the frequency of the synchronous signals outputted from the image processing chip to the backlight processing unit of the backlight driving module is relatively low, for example, the frequency of the synchronous signals outputted from the image processing chip to the backlight processing unit of the backlight driving module is 50 Hz or 60 Hz, if the backlight processing unit directly and simultaneously outputs the received synchronous signals with relatively low frequency to the PWM driver of the backlight driving module, then the frequency of the multiple paths of control signals generated by the PWM driver according to the synchronous signals is also relatively low. As a result, the refreshing frequency is relatively low when the backlight source performs refreshing according to the control signals. Therefore, backlight blinking is distinct during lighting up of the backlight source due to low refreshing frequency; thus the backlight processing unit is needed for conducting frequency multiplication processing to synchronous signals detected from the image processing chip; at the same time, the backlight processing unit performs compensation to frequency jitters of the synchronous signals.

Before determining the output delay compensation value of the synchronous signals, the backlight processing unit firstly determines an output cycle of the synchronous signals, and may determine the output cycle of the synchronous signals according to the N time intervals of the N+1 synchronous signals.

The N+1 synchronous signals have N time intervals, the time interval between the last synchronous signal and the second last synchronous signal in the N+1 synchronous signals detected by the backlight processing unit is $T_N$, which is to say, $T_N$ is the last time interval in the N time intervals; and the output cycle of the synchronous signals is computed as $T'=T_N/x$ according to the last time interval $T_N$ and the frequency multiplication number x for performing frequency multiplication processing on the synchronous signals by the backlight processing unit.

For example, if the frequency multiplication number x is 2, then the output cycle of the synchronous signals is $T'=T_N/2$.

Or, the backlight processing unit determines the time intervals of the last M synchronous signals in the N+1 detected synchronous signals, in other words, the last M time intervals in the N time intervals may be determined; the backlight processing unit may compute the output cycle of the synchronous signals as $$T' = \left(\sum_{N-M}^{N} T_i\right) \Big/ (M \times x)$$

according to the sum of the last M time intervals and according to the frequency multiplication number x for performing frequency multiplication processing on the synchronous signals by the backlight processing unit.

For example, if 101 synchronous signals are detected, time intervals of the last 10 synchronous signals in the 101 synchronous signals are determined, where N is 101, M is 10, and the frequency multiplication number x is 2, then the output cycle of the synchronous signals may be obtained as $$T' = \left(\sum_{90}^{100} T_i\right) \Big/ (10 \times 2).$$

Accordingly, step 103 may include:

Adjust the cycle of the synchronous signals according to the output cycle of the synchronous signals, and generate a compensated synchronous signal by applying the output delay compensation value of the synchronous signals to a synchronous signal with the adjusted cycle.

Figure 10:
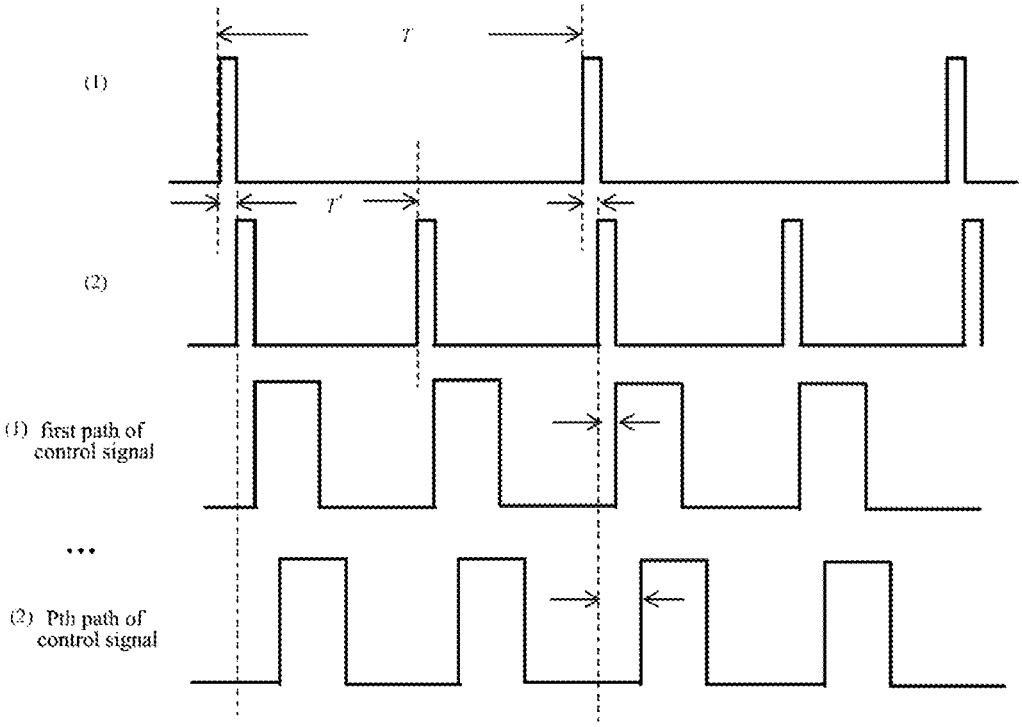
FIG. 10 is a timing diagram of synchronous signals in a method for controlling a backlight source provided by yet another several embodiments of the present application.

FIG. 10 is a timing diagram of synchronous signals in a method for controlling a backlight source provided by yet another several embodiments of the present application, where number (1) in FIG. 10 is a timing diagram of synchronous signals received by a backlight processing unit from an image processing chip; number (2) in FIG. 10 is a timing diagram of synchronous signals transmitted by a backlight processing unit to a PWM driver; number (3) in FIG. 10 is a timing diagram of a first path of control signal in P paths of control signals transmitted by a PWM driver to a backlight source; and number (4) in FIG. 10 is a timing diagram of a Pth path of control signal in P paths of control signals transmitted by a PWM driver to a backlight source. As shown in the timing diagrams indicated by number (1) and number (2) in FIG. 10, the backlight processing unit adjusts the cycle of the synchronous signals according to the computed output cycle of the synchronous signals, where the cycle of the synchronous signals is adjusted from T to T', such that the frequency of the synchronous signals may be increased.

For example, the backlight processing unit conducts frequency multiplication processing to the synchronous signals with a multiplication number of 2. If the frequency of the synchronous signals outputted from the image processing chip to the backlight processing unit is 50 Hz or 60 Hz, then the frequency of the synchronous signals outputted from the backlight processing unit to the PWM driver is 100 Hz or 120 Hz, therefore the cycle of the synchronous signals outputted from the backlight processing unit to the PWM driver is twice that of the synchronous signals received from the image processing chip.

Meanwhile, apply the output delay compensation value $T_0'=(T_0+T_c)/x$ computed for the next synchronous signal of the N+1 synchronous signals to the next synchronous signal, at this moment, x is a positive integer greater than or equal to 2; in such a way, an output delay compensation value is applied to the next synchronous signal of the N+1 synchronous signals, so that the next synchronous signal of the N+1 synchronous signals may be compensated; compensated synchronous signals may be generated after continuously repeating the processes in step 101 to step 103 for the synchronous signals.

In some embodiments, apply the computed output delay compensation value $T_0'=(T_0+T_c)/x$ of the N+1 synchronous signal to M synchronous signals following the N+1 synchronous signals, so that these M synchronous signals may be compensated, and thus M compensated synchronous signals may be generated.

The backlight processing unit transmits the compensated synchronous signals, as well as the generated duty cycle data and backlight current data to the PWM driver, where the compensated synchronous signals are synchronous signals after being subject to frequency multiplication and delay compensation; and the PWM driver generates multiple paths of control signals with relatively high frequency according to the synchronous signals after the frequency multiplication and delay compensation, and according to the duty cycle data and backlight current data, as shown in timing diagrams indicated by number (3) and number (4) in FIG. 10, and then the PWM driver transmits the multiple paths of control signals with relatively high frequency to the backlight source.

In the present application, by determining the output cycle of the synchronous signals according to respective time intervals of the synchronous signals after the backlight processing unit conducting frequency multiplication processing to the synchronous signals, and further adjusting the cycle of the synchronous signals according to the output cycle, the frequency of the synchronous signals outputted to the PWM driver of the backlight driving module may be adjusted, thereby avoiding the situation where the frequency of the multiple paths of control signals transmitted from the PWM driver to the backlight source is relatively low, and thus avoiding the problem of distinct backlight blinking during lighting up of the backlight source due to low refreshing frequency; and in the case where the synchronous signals are subject to frequency multiplication processing, the present application may further alleviate the backlight blinking of the backlight source, and improve the image quality of the liquid crystal display. And at the same time, the magnitude of frequency jitters of the synchronous signals is reduced due to the cycle compensation performed to the subsequent synchronous signal of the synchronous signals; and further, the frequency jitter problem of the synchronous signals transmitted by the image processing chip to the backlight driving module may be lessened.

Figure 11:
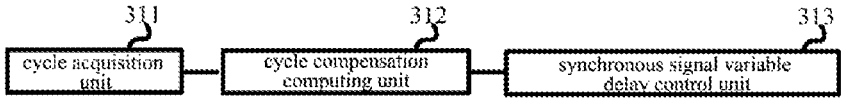
FIG. 11 is a structural diagram of a device for controlling a backlight source provided by several embodiments of the present application.

FIG. 11 is a structural diagram of a device for controlling a backlight source provided by several embodiments of the present application, as shown in FIG. 11, the device includes:

a cycle acquisition unit 311, a cycle compensation computing unit 312, and a synchronous signal variable delay control unit 313;

the cycle compensation computing unit 312 is connected between the cycle acquisition unit 311 and the synchronous signal variable delay control unit 313;

the cycle acquisition unit 311 is configured to determine time intervals of received synchronous signals;

the cycle compensation computing unit 312 is configured to determine an output delay compensation value of the synchronous signals according to the time intervals and fixed response delay time for processing the synchronous signals;

the synchronous signals variable delay control unit 313 is configured to generate a compensated synchronous signal according to the output delay compensation value of the synchronous signals; and transmit the compensated synchronous signal to a PWM driver.

The device for controlling the backlight source may execute the method for controlling the backlight source provided by the embodiments of the present application, and is realized under a similar principle, which will not be repeated herein.

In the present application, by detecting synchronous signals outputted by the image processing chip, receiving partition backlight data outputted from the image processing chip, and computing the output delay compensation value of the synchronous signals according to time intervals of the synchronous signals and fixed response delay time for processing the synchronous signals, cycle compensation may be conducted to the subsequent synchronous signals of the synchronous signals, so as to reduce the magnitude of frequency jitters of the synchronous signals; dynamic cycle compensation to the synchronous signals can alleviate the frequency jitter problem of the synchronous signals outputted to the backlight driving module by the image processing chip, so that the PWM driver can receive synchronous signals with frequency jitters having a reduced magnitude, as well as duty cycle data and backlight current data, and thus, frequency jitters of multiple paths of control signals generated by the PWM driver according to these data and signals will also be reduced, allowing the backlight source to receive multiple paths of control signals, generated by the PWM driver, with relatively stable frequency; and finally the backlight source can perform optical display according to the multiple paths of control signals with relatively stable frequency, thus alleviating backlight blinking phenomenon of the backlight source, lessening backlight blinking of the backlight source, thereby improving image quality of the liquid crystal display.

Figure 12:
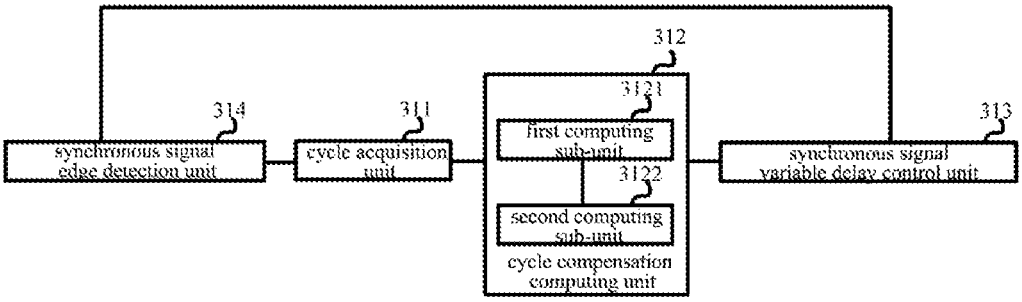
FIG. 12 is a structural diagram of a device for controlling a backlight source provided by another several embodiments of the present application.

FIG. 12 is a structural diagram of a device for controlling a backlight source provided by another several embodiments of the present application, and based on the above embodiments, as shown in FIG. 12, the device also includes:

a synchronous signal edge detection unit 314, which is respectively connected with the cycle acquisition unit 311 and the synchronous signal variable delay control unit 313;

the synchronous signal edge detection unit 314 is configured to receive synchronous signals and partition backlight data outputted from the image processing chip, and sends the synchronous signals and partition backlight data to the synchronous signal variable delay control unit 313.

The cycle acquisition unit 311 is specifically configured to determine N time intervals of the received N+1 synchronous signals which are outputted from the image processing chip, where N is a positive integer;

accordingly, the cycle compensation computing unit 312 includes:

a first computing sub-unit 3121, which is configured to determine an adjustment factor according to the N time intervals of the N+1 synchronous signals and a preset adjustment formula, where the first computing sub-unit 3121 is specifically configured to: determine the adjustment factor $$T_c = \left(\sum_{N-M}^{N} T_i\right) \Big/ M - T_N$$

according to the N time intervals $T_i$ of the N+1 synchronous signals;

a second computing sub-unit 3122, which is configured to determine an output delay compensation value of the synchronous signals according to the adjustment factor, fixed response delay time for processing the synchronous signals, and a preset compensation value determination formula, where the second computing sub-unit 3122 is specifically configured to: determine the output delay compensation value $T_0=(T_0+T_c)/x$ of the synchronous signals according to the adjustment factor $T_c$, and the fixed response delay time for processing the synchronous signals $T_0$, where x is a frequency multiplication number for performing frequency multiplication processing on the synchronous signals; where $i \in [1,N]$, M, i and x are positive integers.

In the present application, the device for controlling the backlight source may execute the method for controlling the backlight source provided by the embodiments of the present application, which is realized under a similar principle, and will not be repeated herein.

In the present application, by determining an adjustment factor according to time intervals of synchronous signals, and computing the output delay compensation value of the N+1 synchronous signals according to the adjustment factor and intrinsic fixed response delay time during processing of the synchronous signals by the backlight processing unit, the computed output delay compensation values may be applied to the subsequent synchronous signals of the synchronous signals, and then cycle compensation is performed to the subsequent synchronous signal of the synchronous signals, so as to reduce the magnitude of frequency jitters of the synchronous signals; dynamic cycle compensation to the synchronous signals may alleviate the frequency jitter problem of the synchronous signals transmitted by the image processing chip to the backlight driving module, so that the PWM driver may receive synchronous signals with frequency jitters having a reduced magnitude, as well as duty cycle data and backlight current data, and thus frequency jitters of the multiple paths of control signals generated by the PWM driver according to these data and signals will also be reduced, allowing the backlight source to receive multiple paths of control signals, generated by the PWM driver, with relatively stable frequency, and finally the backlight source may perform optical display according to the multiple paths of control signals with relatively stable frequency, thereby alleviating backlight blinking phenomenon of the backlight source, lessening backlight blinking of the backlight source, thereby improving the image quality of the liquid crystal display.

Figure 13:
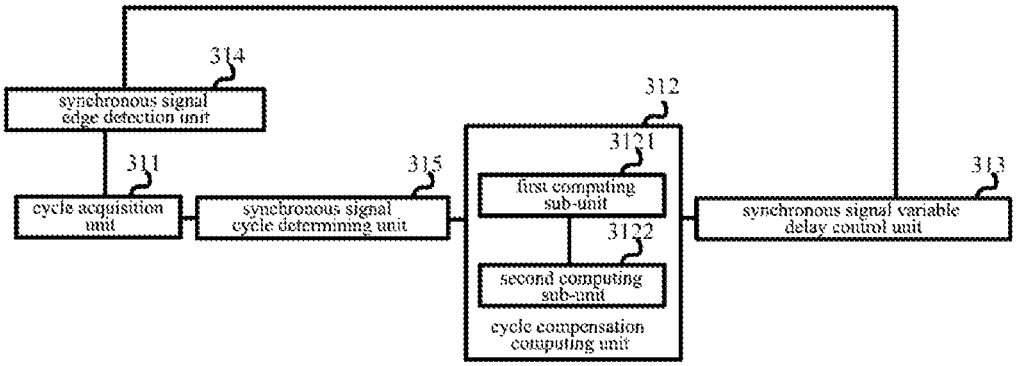
FIG. 13 is a structural diagram of a device for controlling a backlight source provided by yet another several embodiments of the present application.

FIG. 13 is a structural diagram of a device for controlling a backlight source provided by yet another several embodiments of the present application, based on the above embodiments, as shown in FIG. 13, x is a positive integer greater than or equal to 2;

accordingly, the device for controlling the backlight source provided by the present application also includes:

a synchronous signal cycle determining unit 315, which is configured to determine an output cycle of the synchronous signals according to the N time intervals of the N+1 synchronous signals, before the cycle compensation computing unit 312 determines the output delay compensation value of the synchronous signals.

The synchronous signal variable delay control unit 313 is specifically configured to:

adjust the cycle of the synchronous signals according to the output cycle of the synchronous signals, and generate a compensated synchronous signal by applying the output delay compensation value of the synchronous signals to the synchronous signals with an adjusted cycle; and to generate duty cycle data and backlight current data according to the compensated synchronous signals and partition backlight data, and transmit the duty cycle data, backlight current data and compensated synchronous signals to the PWM driver.

The synchronous signal cycle determining unit 315 is specifically configured to:

determine the output cycle $T'=T_N/x$ of the synchronous signals according to the last time interval $T_N$ in the N time intervals of the N+1 synchronous signals, and according to a frequency multiplication number x for performing frequency multiplication processing on the synchronous signals.

Or, the synchronous signal cycle determining unit 315 is specifically configured to:

determine the output cycle $$T' = \left(\sum_{N-M}^{N} T_i\right) \Big/ (M \times x)$$

of the synchronous signals according to the last M time intervals in the N time intervals of the N+1 synchronous signals, and according to the frequency multiplication number x for performing frequency multiplication processing on the synchronous signals.

The device for controlling the backlight source provided by the present application may execute the method for controlling the backlight source provided by the embodiments of the present application, which is realized under a similar principle, and will not be repeated herein.

The present application also provides a device for controlling a backlight source, which includes a processor and a non-transitory processor-readable medium including computer-executable instructions executed by the computing hardware to perform, on the device, operations including: determining time intervals of received synchronous signals; determining an output delay compensation value of the synchronous signals according to the time intervals and fixed response delay time for processing the synchronous signals; generating a compensated synchronous signal according to the output delay compensation value of the synchronous signals; and transmitting the compensated synchronous signal to a PWM driver.

The operations further include those of the method for controlling the backlight source provided by any of the above embodiments of the present application, which are realized under a similar principle, and will not be repeated herein.

In the present application, by determining the output cycle of the synchronous signals according to respective time intervals of the synchronous signals after the backlight processing unit conducting frequency multiplication processing to the synchronous signals, and further adjusting the cycle of the synchronous signals according to the output cycle, the frequency of the synchronous signals outputted to the PWM driver of the backlight driving module may be adjusted, thereby avoiding the situation where the frequency of the multiple paths of control signals transmitted from the PWM driver to the backlight source is relatively low, and thus avoiding the problem of distinct backlight blinking during lighting up of the backlight source due to low refreshing frequency; and in the case where the synchronous signals are subject to frequency multiplication processing, the present application may further alleviate the backlight blinking of the backlight source, and improve the image quality of the liquid crystal display. And at the same time, the magnitude of frequency jitters of the synchronous signals is reduced due to the cycle compensation performed to the subsequent synchronous signal of the synchronous signals; and further, the frequency jitter problem of the synchronous signals transmitted by the image processing chip to the backlight driving module may be lessened.

Figure 14:
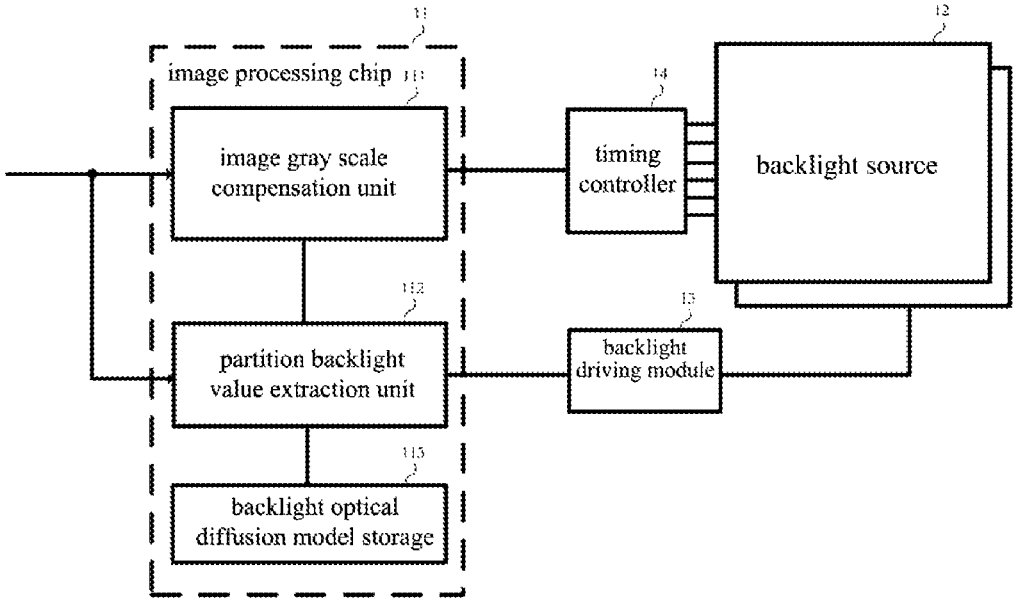
FIG. 14 is a circuit diagram of a liquid crystal display provided by several embodiments of the present application.
Figure 15:
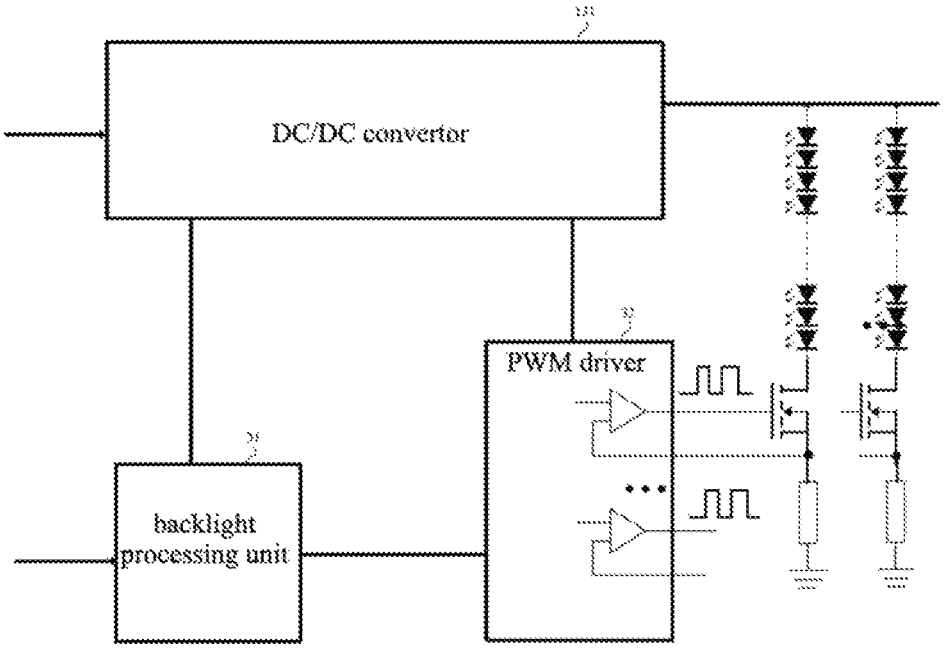
FIG. 15 is a circuit diagram of a device for controlling a backlight source in a liquid crystal display provided by several embodiments of the present application.

FIG. 14 is a circuit diagram of a liquid crystal display provided by several embodiments of the present application, and FIG. 15 is a circuit diagram of a device for controlling a backlight source in a liquid crystal display provided by several embodiments of the present application As shown in FIG. 14 and FIG. 15, the liquid crystal display includes:

an image processing chip 11, a backlight source 12, a device 31 for controlling the backlight source provided by the above embodiments, and a PWM driver 32;

the device 31 for controlling the backlight source is connected between the image processing chip 11 and the PWM driver 32, and the PWM driver 32 is arranged between the device 31 for controlling the backlight source and the backlight source 12.

The backlight processing unit in FIG. 14 is the device for controlling the backlight source as mentioned in the above embodiments, and both of the device 31 for controlling the backlight source and the PWM driver 32 are arranged in a backlight driving module 13. As shown in FIG. 14 and FIG. 15, the liquid crystal display is provided with the image processing chip 11, the backlight source 12, the backlight driving module 13 and a timing controller 14, where the backlight driving module 13 is provided with the backlight processing unit 31, the PWM driver 32 and a DC/DC convertor 131; the image processing chip 11 is composed of an image gray scale compensation unit 111, a partition backlight value extraction unit 112 and a backlight optical diffusion model storage unit 113 and other units; the image processing chip 11 is connected with the backlight processing unit 31 of the backlight driving module 13, and the backlight source 12 is connected with the PWM driver 32 of the backlight driving module 13.

After the image processing chip 11 receives video signals, the image gray scale compensation unit 111, the partition backlight value extraction unit 112 and the backlight optical diffusion model storage unit 113 and other units of the image processing chip 11 perform image processing to the video signals, then the image gray scale compensation unit 111 of the image processing chip 11 outputs image data to the timing controller 14, and the partition backlight value extraction unit 112 of the image processing chip 11 outputs synchronous signals and partition backlight data to the backlight processing unit 31 of the backlight driving module 13. The DC/DC convertor 131 of the backlight driving module 13 is configured to conduct operations such as protection detection of the backlight processing unit 31, receiving feedback signals outputted by the PWM driver 32 and so on.

The liquid crystal display adopts the method for controlling the backlight source provided by the above embodiments, and adopts the device for controlling the backlight source provided in the above embodiments under the same specific principle as the above embodiments, and will not be repeated herein.

In the present application, the liquid crystal display adopts the method for controlling the backlight source provided by the above embodiments; by detecting synchronous signals outputted by the image processing chip, receiving partition backlight data outputted from the image processing chip, and computing the output delay compensation value of the synchronous signals according to time intervals of the synchronous signals and fixed response delay time for processing the synchronous signals, cycle compensation may be conducted to the subsequent synchronous signal of the synchronous signals, so as to reduce the magnitude of frequency jitters of the synchronous signals; dynamic cycle compensation to the synchronous signals may alleviate the frequency jitter problem of the synchronous signals outputted by the image processing chip to the backlight driving module, in such a way, the PWM drive may receive synchronous signals with frequency jitters having a reduced magnitude, as well as duty cycle data and backlight current data, and thus, the frequency jitters of the multiple paths of control signals generated by the PWM driver according to these data and signals will also be reduced, allowing the backlight source to receive multiple paths of control signals, generated by the PWM driver, with relatively stable frequency; and finally the backlight source may perform optical display according to the multiple paths of control signals with relatively stable frequency, thus alleviating backlight blinking phenomenon of the backlight source, lessening backlight blinking of the backlight source, thereby improving the image quality of the liquid crystal display. At the same time, by determining the output cycle of the synchronous signals according to respective time intervals of the synchronous signals after performing frequency multiplication processing on the synchronous signals, and further adjusting the cycle of the synchronous signals according to the output cycle, the frequency of the synchronous signals outputted to the PWM driver of the backlight driving module may be adjusted, thereby avoiding the situation where the frequency of the multiple paths of control signals transmitted by the PWM driver to the backlight source is relatively low, and thus avoiding the problem of distinct backlight blinking during lighting up of the backlight source due to low refreshing frequency.

One with ordinary skill in the art may understand that, part or all of the steps for achieving embodiments of the above methods may be completed via hardware related to program instructions. The aforementioned program may be stored in a computer readable storage medium. When the program runs, the steps of the embodiments of the method are performed; and the above storage medium includes: a ROM, a RAM, a disk, an optical disk or other mediums capable of storing program codes.

Finally, it should be stated that, the above embodiments are merely intended to illustrate rather than to limit the technical solutions of the present application; although the present application has been detailed in conjunction with the above embodiments, those skilled in the art should understand that, one can still make modifications to the technical solutions recorded in the above embodiments, or make equivalent substitutions to part of the technical features therein; and neither these modifications nor these substitutions shall make the essence of the corresponding technical solutions deviate from the spirit and scope of the technical solutions in the embodiments of the present application.

What is claimed is:

1. A method for controlling a backlight source, comprising:

determining N time intervals of N+1 pulses of a synchronous signal outputted by an image processing chip, wherein N is a positive integer;

determining an adjustment factor according to the N time intervals of the N+1 pulses of the synchronous signal and a preset adjustment formula;

determining an output delay compensation value of the synchronous signal, according to the adjustment factor, fixed response delay time for processing the synchronous signal and a preset compensation value determination formula;

generating a compensated synchronous signal according to the output delay compensation value of the synchronous signal; and transmitting the compensated synchronous signal to a pulse width modulation (PWM) driver.

2. The method according to claim 1, wherein before the determining N time intervals of N+1 pulses of a synchronous signal outputted by an image processing chip, the method also comprises:

receiving the synchronous signal and partition backlight data outputted by the image processing chip.

3. The method according to claim 1, wherein the determining an adjustment factor according to the N time intervals of the N+1 pulses of the synchronous signal and a preset adjustment formula, comprises:

determining an adjustment factor $T_c=(\Sigma_{N-M}\ T_t)/M-T_c$ according to the N time intervals $T_i$ of the N+1 pulses of the synchronous signal; the determining an output delay compensation value of the synchronous signal, according to the adjustment factor, fixed response delay time for processing the synchronous signal and a preset compensation value determination formula, comprises:

determining an output delay compensation value $T_o=(T_o+T_e)/x$ of the synchronous signal, according to the adjustment factor $T_c$ and fixed response delay time $T_o$ for processing the synchronous signal, wherein x is a frequency multiplication number for performing frequency multiplication processing on the synchronous signal;

wherein $_i$€[1, N],M, I, x are positive integers.

4. The method according to claim 3, wherein x is a positive integer greater than or equal to 2;

before the determining an adjustment factor according to the N time intervals of the N+1 pulses of the synchronous signal and a preset adjustment formula, the method also comprises:

determining an output cycle of the synchronous signal according to the N time intervals of the N+1 pulses of the synchronous signal;

the generating a compensated synchronous signal according to the output delay compensation value of the synchronous signal, comprises:

adjusting a cycle of the synchronous signal according to the output cycle of the synchronous signal, and generating a compensated synchronous signal by applying the output delay compensation value of the synchronous signal to a synchronous signal with an adjusted cycle.

5. The method according to claim 4, wherein the determining an output cycle of the synchronous signal, according to the N time intervals of the N+1 pulses of the synchronous signal, comprises:

determining an output cycle $T=T_N/x$ of the synchronous signal, according to a last time interval $T_N$ in the N time intervals of the N+1 pulses of the synchronous signal and the frequency multiplication number x for performing frequency multiplication processing on the synchronous signal.

6. The method according to claim 4, wherein the determining an output cycle of the synchronous signal according to the N time intervals of the N+1 pulses of the synchronous signal, comprises:

determining an output cycle $T'=(\Sigma_{N-M} T_i)/(M\times x)$ of the synchronous signal, according to last M time intervals in the N time intervals of the N+1 pulses of the synchronous signal and the frequency multiplication number x for performing frequency multiplication processing on the synchronous signal.

7. The method according to claim 1, wherein the transmitting the compensated synchronous signal to a PWM driver, comprises:

generating duty cycle data and backlight current data according to the compensated synchronous signal and received partition backlight data, and transmitting the duty cycle data, the backlight current data and the compensated synchronous signal to the PWM driver.

8. A liquid crystal display, comprising a processor and a non-transitory processor-readable medium including computer-executable instructions executed by the computing hardware to perform, on the liquid crystal display, operations comprising:

determining time intervals of a synchronous signal;

determining an output delay compensation value of the synchronous signal, according to the time intervals and fixed response delay time for processing the synchronous signal; and generating a compensated synchronous signal according to the output delay compensation value of the synchronous signal; and transmitting the compensated synchronous signal to a pulse width modulation (PWM) driver, wherein the operation of determining time intervals of a synchronous signal comprises:

determining N time intervals of N+1 pulses of the synchronous signal outputted by an image processing chip, wherein N is a positive integer;

wherein the operation of determining an output delay compensation value of the synchronous signal, according to the time intervals and fixed response delay time for processing the synchronous signal comprises:

determining an adjustment factor according to the N time intervals of the N+1 pulses of the synchronous signal and a preset adjustment formula; and determining an output delay compensation value of the synchronous signal according to the adjustment factor, the fixed response delay time for processing the synchronous signal and a preset compensation value determination formula.

9. The liquid crystal display according to claim 8, wherein before the determining time intervals of a synchronous signal, the operations further comprise:

receiving the synchronous signal and partition backlight data outputted by the image processing chip.

10. The liquid crystal display according to claim 8, wherein the operations further comprise:

determine the adjustment factor $T_c=(\Sigma_{N-M} T_i)/M-T_N$ according to the N time intervals $T_i$ of the N+1 pulses of the synchronous signal;

determining the output delay compensation value $T_o=(T_o+T_c)/x$ of the synchronous signal, according to the adjustment factor $T_c$, and the fixed response delay time $T_o$ for processing the synchronous signal, wherein x is a frequency multiplication number for performing frequency multiplication processing on the synchronous signal;

wherein i€[1, N],M, I, x are positive integers.

11. The liquid crystal display according to claim 10, wherein, x is a positive integer greater than or equal to 2;

the operations further comprise:

determining an output cycle of the synchronous signal according to the N time intervals of the N+1 pulses of the synchronous signal before determining the output delay compensation value of the synchronous signal; and adjusting a cycle of the synchronous signal according to the output cycle of the synchronous signal, and generating a compensated synchronous signal by applying the output delay compensation value of the synchronous signal to a synchronous signal with an adjusted cycle; generating duty cycle data and backlight current data according to the compensated synchronous signal and partition backlight data, and transmitting the duty cycle data, the backlight current data and the compensated synchronous signal to the PWM driver.

12. The liquid crystal display according to claim 11, wherein the operations further comprise:

determining the output cycle $T'=T_N/x$ of the synchronous signal, according to a last time interval $T_N$ in the N time intervals of the N+1 pulses of the synchronous signal and a frequency multiplication number x for performing frequency multiplication processing on the synchronous signal.

13. The liquid crystal display according to claim 11, wherein the operations further comprise:

determining the output cycle $T'=(\Sigma_{N-M} T_i)/(M\times x)$ of the synchronous signal, according to last M time intervals in the N time intervals of the N+1 pulses of the synchronous signal and a frequency multiplication number x for performing frequency multiplication processing on the synchronous signal.

14. The liquid crystal display, comprising:

an image processing chip, a backlight processor, a pulse width modulation (PWM) driver, a backlight source;

the backlight processor is connected between the image processing chip and the PWM driver, and the PWM driver is connected between the backlight processor and the backlight source;

the image processing chip is configured to conduct image processing to inputted video signals and generate a synchronous signal and partition backlight data;

the backlight processor is configured to:

receive the synchronous signal and the partition backlight data;

detect N time intervals among N+1 pulses of the received synchronous signal;

determine an adjustment factor according to the N time intervals of the N+1 pulses of the synchronous signal and a preset adjustment formula;

determine an output delay compensation value of the synchronous signal, according to the adjustment factor, fixed response delay time for processing the synchronous signal and a preset compensation value determination formula;

generate a compensated synchronous signal according to the output delay compensation value of the synchronous signal and the synchronous signal; and output the partition backlight data and the compensated synchronous signal, the PWM driver is configured to receive the partition backlight data and the compensated synchronous signal outputted by the backlight processor; and generate control signals according to the partition backlight data and the compensated synchronous signal; and the backlight source is configured to receive the control signals and be lit up according to the received control signals.

15. The liquid crystal display according to claim 14, wherein the backlight processor is configured to apply the output delay compensation value of the synchronous signal to an (N+2)th pulse of the synchronous signal to generate the compensated synchronous signal.

16. The liquid crystal display according to claim 14, wherein values of the time delays of the P paths of the control signals form an arithmetic progression.

* * * * *